US005426858A

United States Patent [19]

Clark et al.

[11] Patent Number: 5,426,858

[45] Date of Patent: Jun. 27, 1995

[54] COMBINATION CENTER PUNCH AND PRICK PUNCH

[75] Inventors: Emory J. Clark, Spokane; Robert J. Warner, Veradale, both of Wash.

[73] Assignee: Spring Line, Inc., Spokane, Wash.

[21] Appl. No.: 47,581

[22] Filed: Apr. 13, 1993

[51] Int. Cl.[6] ..... B26F 1/00

[52] U.S. Cl. ..... 30/367; 30/358; 81/463

[58] Field of Search ..... 30/316, 358, 359, 168, 30/367; 81/912, 463

[56] References Cited

U.S. PATENT DOCUMENTS

| | | | |
|---|---|---|---|
| 833,712 | 10/1906 | Geisenhoner | 30/367 |
| 1,458,961 | 6/1923 | Williams | 30/168 |
| 2,602,360 | 7/1952 | Berninger | 30/367 |
| 2,675,079 | 4/1954 | Hughes | 30/367 |
| 4,069,586 | 1/1978 | Skelton | 30/360 |

FOREIGN PATENT DOCUMENTS

| | | | |
|---|---|---|---|
| 877157 | 9/1961 | United Kingdom | 30/168 |

*Primary Examiner*—Richard K. Seidel

*Attorney, Agent, or Firm*—Wells, St. John, Roberts Gregory & Matkin

[57] ABSTRACT

An combination center punch and prick punch impact hand tool 10 has a center punch member 14 with an elongated center punch body 16 extending from a tool tip 20 to an anvil surface 24 at a rear end 22. The hand impact tool 10 has a prick punch member 40 with an elongated forward end 44 having an anvil surface 46 for engaging the anvil surface 24. An elongated coil spring 60 has reduced diameter spring ends 64 and 66 mounted in corresponding spring latching grooves 28 and 54, respectively. Each of the members 14 and 40 have finger gripping sections 26 and 52 that are formed with a series of annular grooves 80 forming finger rings 82 for enabling the user to easily grip and hold the tool member 14 during the operation of the tool and the expansion of the coil spring prior to the release of the prick punch member 40. Upon release of the prick punch member, the anvil surface 46 of the forward end 44 is driven into the anvil surface 24 with a very sharp impact. The number of rings 82 in the finger gripping section 52 is less than the number of rings 82 of in the finger gripping section 26 to minimize premature release of the center punch member prior to the release of the prick punch member 40.

20 Claims, 4 Drawing Sheets

COMBINATION CENTER PUNCH AND PRICK PUNCH

TECHNICAL FIELD

This invention relates to center punch and prick punch impact hand tools.

BACKGROUND OF THE INVENTION

The concept of providing impact hand tools that are spring driven have been suggested for many years. For example U.S. Pat. No. 833,712 granted to H. Geisenhoner on Oct. 16, 1906 show a prick punch hand tool that is spring driven. However such hand tool is rather expensive to manufacture and assemble. Numerous other patents show even more complicated and costly hand tools that are likely to wear out prematurely through repeated use, particularly when used in corrosive, dirty or dusty atmospheres.

Also separate prick punch and center punch tools are required for each function, necessitating multiple tools.

One of the objectives and advantages of this invention is to provide a spring driven impact hand tool having both a prick punch tool member and a center punch tool member for performing different functions that is inexpensive to manufacture and unlikely to wear out, even when used in corrosive, dirty or dusty atmospheres.

These and other advantages of this invention will become apparent upon reading the following detailed description of preferred embodiments.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

A preferred embodiment of the invention is disclosed in the attached drawings showing a combination center punch and prick punch hand impact tool, generally designated with the numeral 10. The hand impact tool 10 is designed to form indentations or marks (scores) on a work surface 12.

Figure 1:
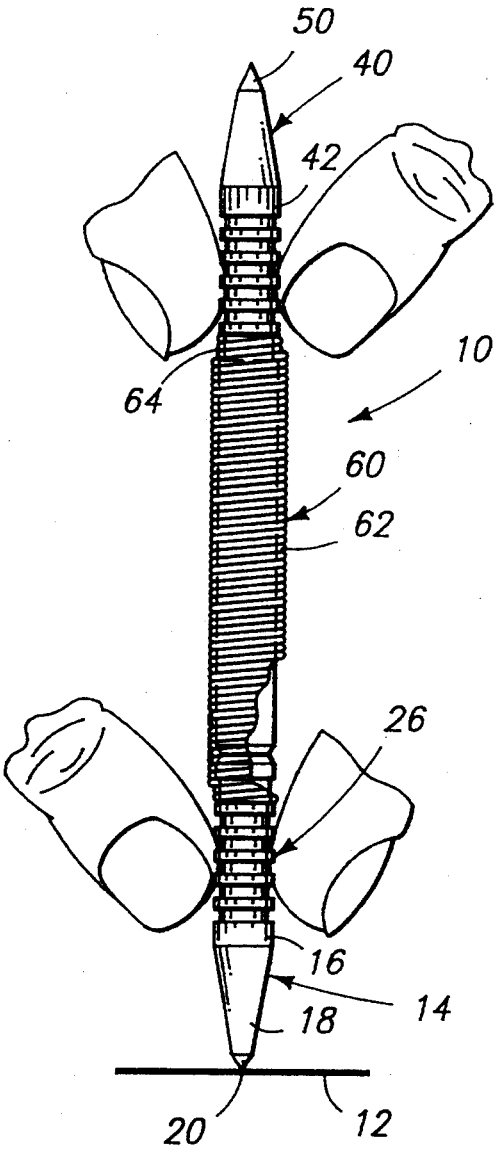
FIG. 1 is a side elevational view of a preferred embodiment of a combination center punch and prick punch impact hand tool shown in an upright orientation with the center punch engaging a work surface with a tension driving spring in a contracted condition.
Figure 2:
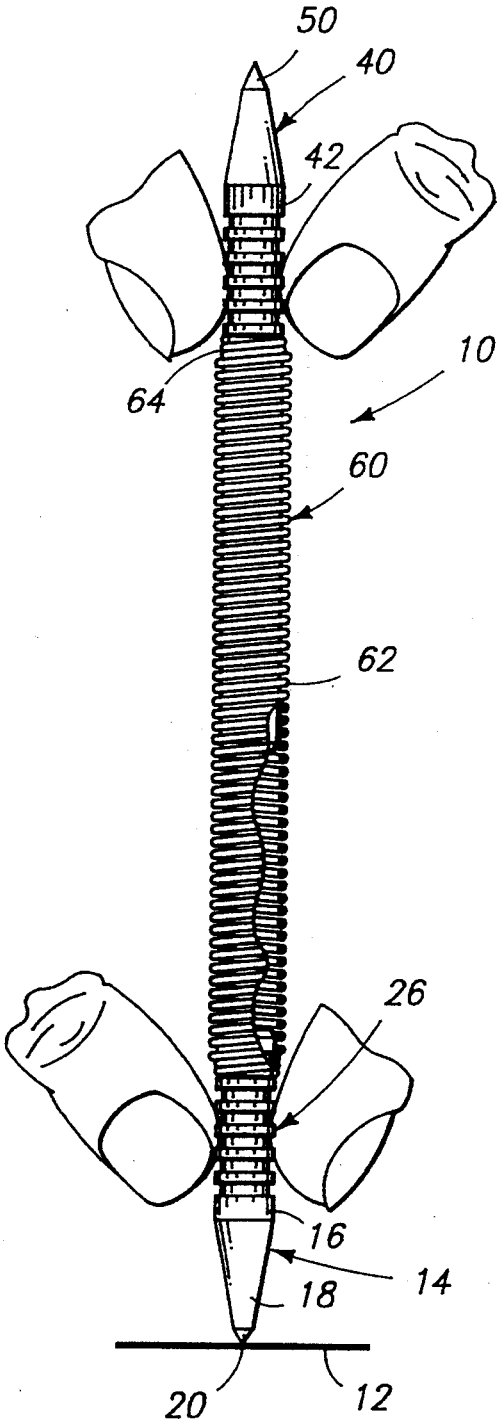
FIG. 2 is a side elevational view similar to FIG. 1 except showing the tool with the driving spring in an expanded condition.
Figure 5:
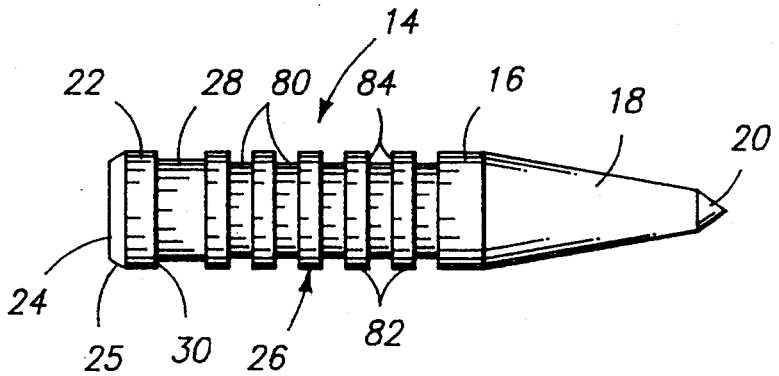
FIG. 5 is an enlarged view of the center punch member of the tool.

The hand impact tool 10 includes a center punch member 14 (FIGS. 5–7) at one end that is placed adjacent to or engaging the work surface 12 as illustrated in FIGS. 1 and 2.

The center punch member 14 includes an elongated cylindrical body 16 having a predetermined maximum diameter. Preferably, the maximum diameter of the tool body 16 is between 0.65 cm. and 0.85 cm. The elongated tool body 16 extends between a front end 18 that has a tool tip 20 and a cylindrical rear end 22 having an anvil surface 24. Preferably, the rear end 22 has a diameter that is substantially equal to the maximum diameter of the tool body 16.

Preferably the rear end 22 has a longitudinal length less than the maximum diameter of the tool body 16. Most preferably the rear end 22 has a longitudinal dimension of between 0.30 cm and 0.50 cm. The anvil surface 24 includes an anvil peripheral bevel 25 to facilitate assembly of the tool 10 and alignment of the impact force, and to minimize anvil deformation along the peripheral edge.

Center punch member 14 has a finger gripping section 26 that is intermediate the front end 18 and cylindrical rear end 22 to enable the user to firmly grip the center punch member 14 between the thumb and forefinger of one hand to position and hold the tool tip 20 in engagement with the work surface 12. The section 26 has enhanced gripping interlocking friction characteristics (large coefficient of friction with respect to human fingers) to minimize the unintentional release of the tool member during usage.

The center punch member 14 further includes a spring latching groove 28 that is formed in the tool body 16 intermediate the finger gripping section 26 and the cylindrical rear end 22. The spring latching groove 28 forms a latching shoulder 30 in conjunction with the cylindrical rear end 22.

Figure 8B:
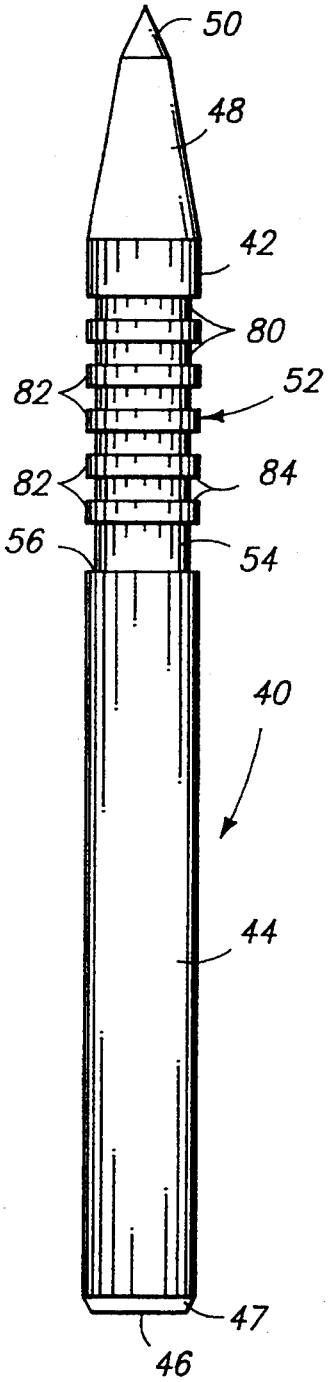
FIG. 8 is an enlarged view of the prick punch member of the tool.
Figure 9:
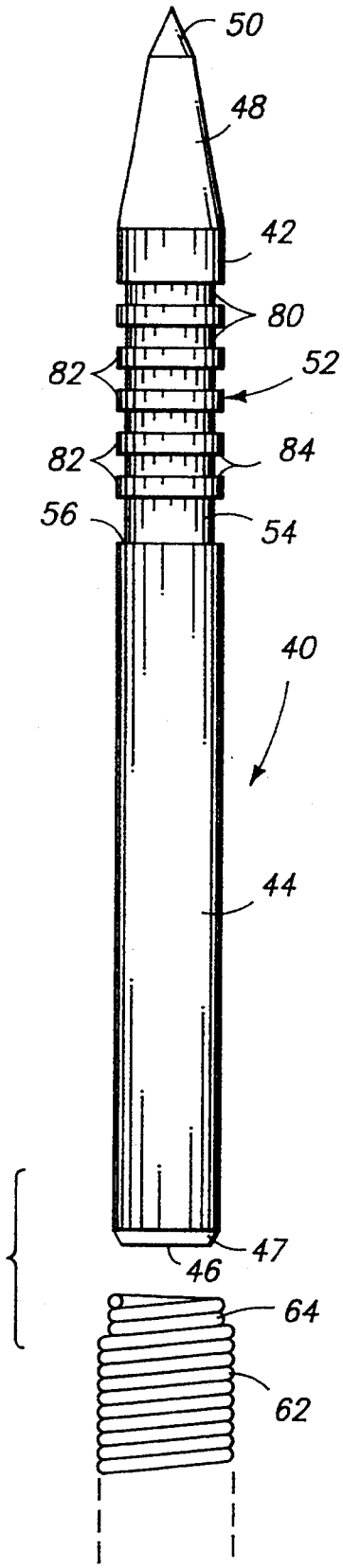
FIG. 9 is an enlarged view of the prick punch member and an opposite end of the tension driving spring as the opposite end of the driving spring is being mounted on the prick punch member.
Figure 10:
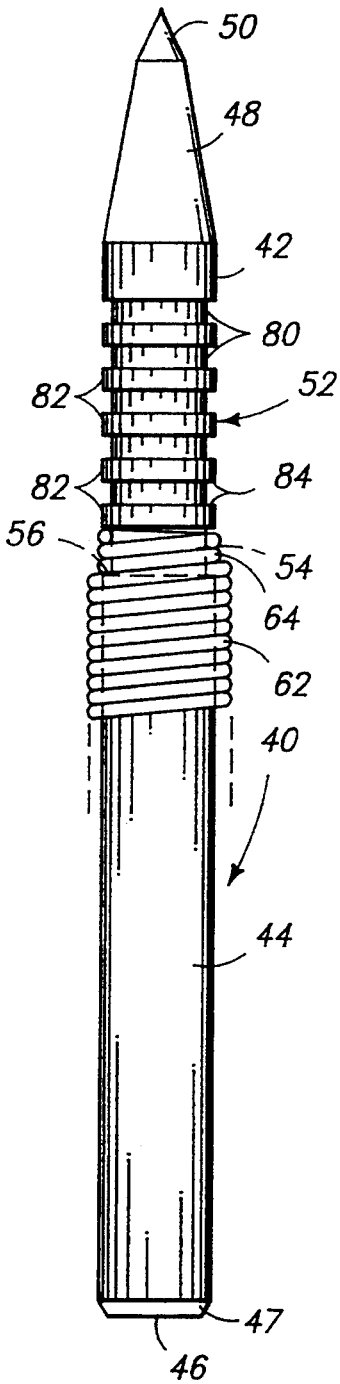
FIG. 10 is an enlarged view similar to FIG. 9 showing the opposite end of the driving spring fully mounted on the prick punch member.

At the opposite end, the hand impact tool 10 has an elongated prick punch member 40 (FIGS. 8–10). The elongated prick punch member 40 has a generally cylindrical elongated prick punch body 42 with a maximum diameter corresponding to the maximum diameter of the tool body 16. The prick punch body 42 extends between a rather massive forward end 44 having an anvil surface 46 and a prick tool end 48 having a tool tip 50. The length and weight of the prick punch body 42 is greater than twice the length and weight of the center punch member body 16. The anvil surface 46 has an anvil peripheral bevel 47 to facilitate the assembly of the impact tool 10 and to facilitate efficient operation of the hand tool 10.

Preferably, the forward end 44 has a diameter corresponding to the maximum diameter of the cylindrical body 42, and most preferably has a diameter between 0.65 cm. and 0.85 cm.

The prick punch member 40 has a finger gripping section 52 that is intermediate the forward end 44 and the prick tool end 48. The finger gripping section 52 preferably has enhanced gripping interlocking friction characteristics (large coefficient of friction with respect to human fingers). Preferably the frictional gripping characteristics of finger gripping section 52, even though large, are less than the frictional characteristics of finger gripping section 26 to minimize the possibility of the premature release of the center punch member 14 prior to the release of the prick punch member 40 when the center punch is engaging the work surface 12.

The prick punch member 40 further includes a spring latching groove 54 formed therein between the finger gripping section 52 and the forward end 44 forming a latching shoulder 56 in conjunction with the forward end 44.

The rather massive forward end 44 has a longitudinal length that is at least twice the longitudinal length of the rear end 22 of the center punch member 14. Preferably, the length of the forward end 44 is more than four times and most preferably more than eight times the length of the rear end 22 to enable the prick punch member 40 to have a large mass and weight that is at least twice that of the center punch member 14. Preferably, the length of the forward end 44 is between 3 cm. and 7 cm. Such an arrangement enables the tool 10 to deliver maximum application of force through the center punch member 14 to the work surface, while still at the same time enabling the user to exercise substantial control of the amount of force applied during any application. When inverted the center punch member 14 delivers a minimum force to the prick punch member 40 to minimize deformation and increase the accuracy of the prick punch in scoring or marking a work surface. Consequently the tool 10 may be used with work surfaces having a wide variance in hardness. Even more importantly the tool can be use on work surfaces that are quite brittle without breaking the work surface since the application of force is accomplished very rapidly causing deformation of the work surface, without fracturing.

The hand impact tool 10 includes an elongated tension coil spring 60 that has a rather large constant diameter central section 62 that extends between reduced spring ends 64 and 66. The reduced spring ends 64 and 66 comprise at least two complete 360 degree coil turns, and preferably between two and five turns. Preferably, the coil spring 60 is made from a high quality spring music wire. Preferably, the coil spring 60 has an initial pre-load or pre-tension of at least 2 oz. and preferably 1.0 to 1.5 lbs. so that the anvil surfaces 24 and 46 are maintained in engagement when the tool is not in use and to increase axial alignment of the anvil surfaces when in use. The coil spring 60 preferably has sufficient strength to enable the spring to expand between 200 and 500 percent of its original length upon the application of the pulling force on the prick punch member 40 that is between 10 and 15 lbs. Preferably, the central section 62 has an inside diameter that is between 0.80 cm. and 0.90 cm. The inside diameter of the central section 62 is greater than the diameter of the forward end 44 so that coils of the spring 60 do not interfere with the movement of the forward end 44. The central section 62 has a small angle helical spiral with a rather large diameter relative to the tool body 16 to maximize the stored energy in the central section when the coil is expanded. Preferably, the reduced spring ends 64 and 66 have an inside diameter of between 0.50 cm. and 0.85 cm. Most preferably, the reduced spring ends 64, 66 have an inside diameter of approximately 0.66 cm. The spring music wire itself, preferably has a diameter of approximately 0.10 cm.

Preferably, the depth of the spring latching grooves 28 and 54 have a depth that is greater than one-half of the diameter of the spring wire of the coil spring 60. Preferably, the depth of the spring latching groove 28 is between 0.050 cm. and 0.080 cm.

The tool tip 20 as illustrated in FIGS. 1–3 and 5–7 has a center punch bevel 70 of approximately 35°. The tool tip 50 of the prick punch tool member 40, illustrated in FIG. 8–10, has a bevel 72 of approximately 25°.

As previously mentioned, the frictional characteristics of the finger gripping section 26 are preferably greater than the finger gripping characteristics of the section 52. Preferably, the finger gripping friction characteristics of section 26 are greater than that of finger gripping section 52 so that a person can easily maintain their grip on the center punch member 14, and hold the center punch member in engagement with the work surface 12 before the prick punch member 40 is released, as illustrated in FIG. 2.

Each of the finger gripping sections 26 and 52 includes a series of spaced annular grooves 80 formed in the tool body 16 having a depth greater than 0.040 cm. Preferably, the depth of each of the grooves 80 is between 0.040 cm. and 0.080 cm., and more preferably between 0.050 cm. and 0.080 cm. The annular spaced grooves 80 form at least two spaced rings 82. In a preferred embodiment, the grooves 80 form annular sharp edges 84 at the sides of the rings 82 to dramatically increase the gripping friction between the user's fingers and the members 14 and 40.

It should be noted that in the preferred embodiment, the finger gripping section 52 has fewer rings 82 than the finger gripping section 26 to minimize premature release of the center punch member 14 prior to the intentional release of the prick punch member 40. As illustrated in the drawing, the finger gripping section 52 has four rings 82 as compared to five rings for the section 26.

Each of the annular grooves 80 has a width that is between 1.5 and 2.5 times the depth of the grooves 80. Preferably, the width of the grooves 80 is between 0.120 cm. and 0.200 cm. Each of the rings 82 has a width that is preferably between 1.5 and 2.5 times the depth of the grooves 80. More preferably, the width of the rings 82 is between 0.120 cm. and 0.200 cm. The large frictional characteristics of the finger gripping sections 26 and 52 increase the safety in use of the hand impact tool, and additionally enables the user to quickly learn the proper distance to retract the prick punch member or the center punch member to obtain the desired results.

Figure 6:
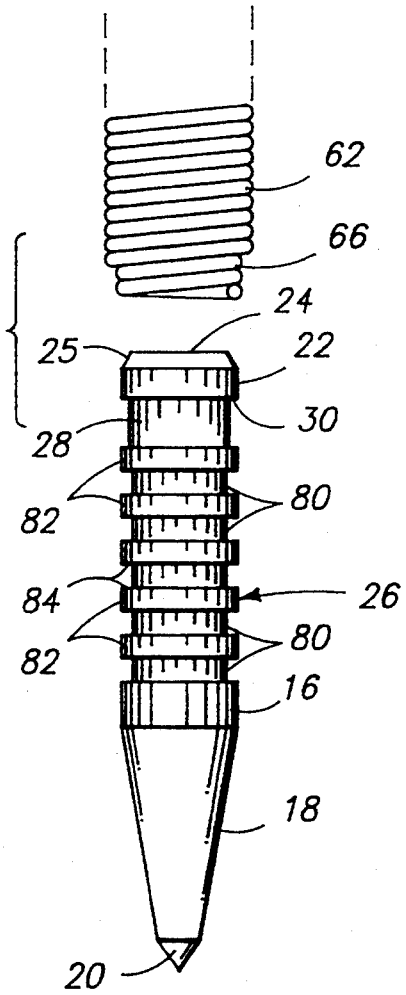
FIG. 6 is an enlarged view of the center punch member and one end of the tension driving spring as the one end of the driving spring is being mounted on the center punch member.
Figure 7:
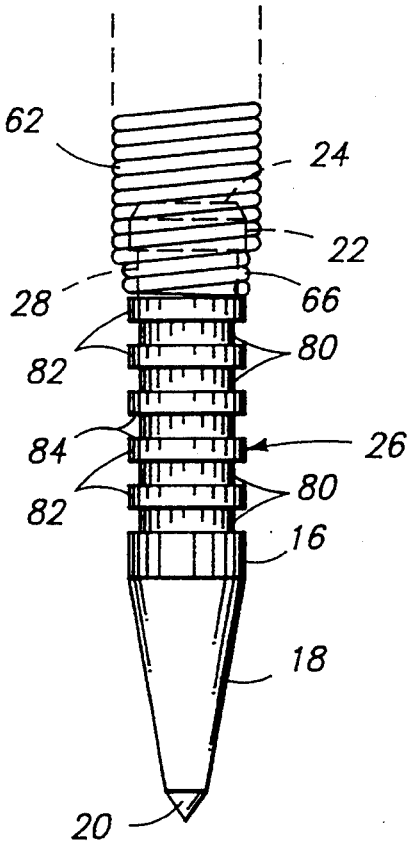
FIG. 7 is an enlarged view similar to FIG. 6 showing the one end of the driving spring fully mounted on the center punch member.

One of the advantages of the hand impact tool 10 is its ease of assembly. No special tools are required. As illustrated in FIGS. 6 and 7, the elongated coil spring 60, and particularly the reduced spring end 64, 66 are easily mounted in their respective latching grooves 54 and 26. This is accomplished by merely pushing and rotating the spring end 64 against the beveled anvil surface 46 (FIG. 9). The peripheral bevel 47 causes the reduced spring end 64 to temporarily expand so that the spring end may be slid along the full length of the forward end 44 as illustrated in FIG. 10. The reduced spring end 64 then snaps into the spring latching groove 54 for permanent attachment with one of the coil turns, firmly engaging the latching shoulder 56 for preventing the release of the reduced spring end 64 from the prick punch member 40.

Likewise, the reduced spring end 66 is mounted to the tool member 14 by merely pushing and rotating the spring end 66 over the anvil rear end 22 until the spring end 66 snaps into the spring latching groove 28. One of the turns of the spring end 66 engages the latching shoulder 30 to prevent release of the spring end from the center punch member during use.

Figure 3:
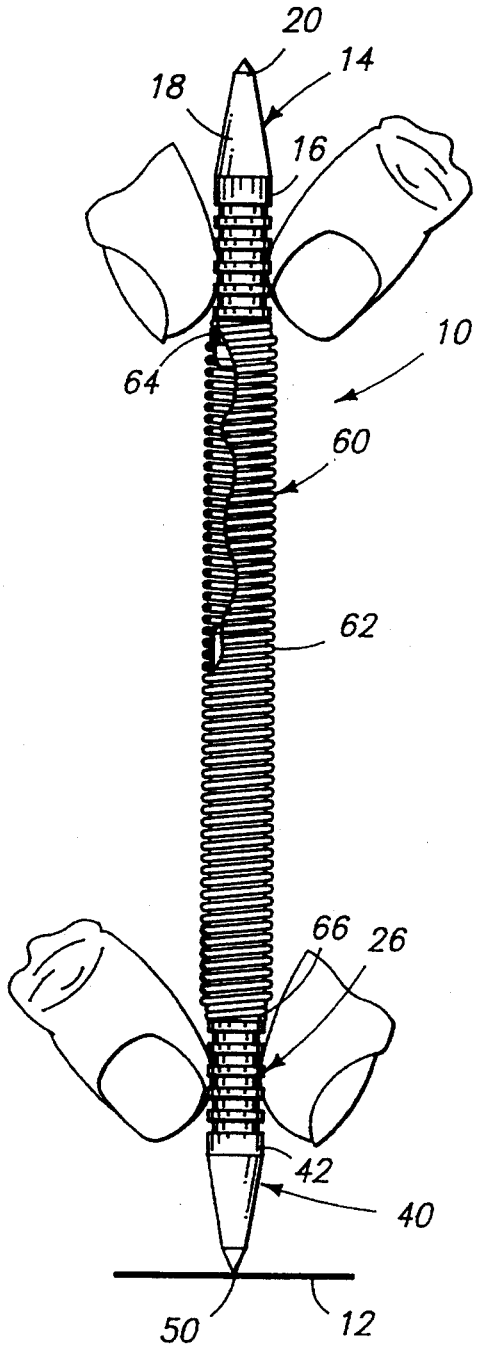
FIG. 3 is a side elevation view similar to FIG. 2 except showing the tool inverted with the prick punch tool member engaging the work surface.
Figure 4:
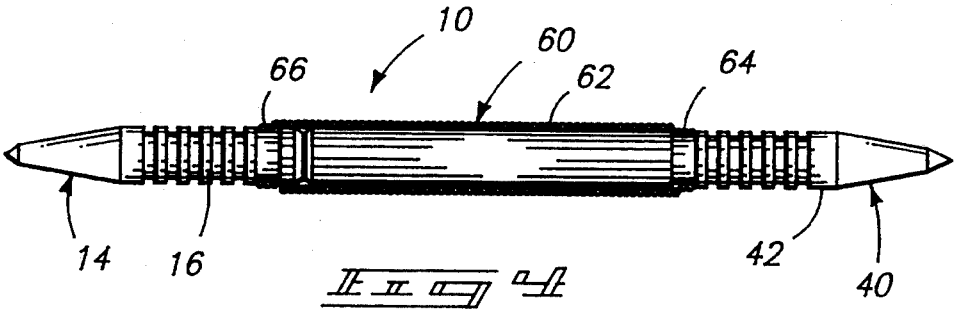
FIG. 4 is a vertical cross sectional view of the tool illustrated in FIG. 1 emphasizing a center punch member at one end and prick punch member at an opposite end.

Use of the hand impact tool is illustrated in FIGS. 1–3. Initially, the user grips the hand impact tool with one hand in which a finger and thumb engages and grips the finger gripping section 26 as illustrated in FIG. 1 to position the center punch member with respect to the work surface 12. After the correct position has been obtained, the user, with the thumb and index finger of the other hand grips the finger gripping section 52 of the prick punch member 40, and begins to pull the prick punch member 40 away from the tool member 14 as illustrated in FIG. 2. Such movement causes the anvil surfaces 24 and 48 to separate, and increases the tension on the spring 60. As the coil spring expands, it increases its potential energy which is converted into dynamic energy when the prick punch member 40 is released. When released, the spring 60 contracts, driving the anvil surface 46 of the forward end 44 into impact engagement with the anvil surface 24 transferring the dynamic energy of the prick punch member 40 to the tool member 14. In this way, a very rapid and high energy impact force is applied to the tool tip 20 and the work surface 12 to rapidly deform the work surface 12.

As illustrated in FIG. 3, the tool 10 is reversed, with the tip 50 of the prick punch member 40 engaging the work surface 12. Since the center punch member 14 is of considerably less mass, preferably less than 50%, the same stroke creates a much smaller force being applied to the prick punch member, enabling the user to more accurately use the tool 10 without unintentionally defacing the work surface 12.

In a preferred embodiment, the center punch member 14 and the prick punch member 40 are made from the same stock of steel material. The tool member 14 and the prick punch member 40 are appropriately heat treated to minimize fracture, fatigue and brittleness, while minimizing deformation of the anvil surfaces 24 and 46 over extended use.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A combination center punch and prick punch impact hand tool, comprising:

an elongated center punch member having a center punch body extending between a center punch tip at a front end and a first anvil surface at a cylindrical rear end;

said cylindrical rear end having a prescribed diameter;

said center punch body having a first finger gripping section intermediate the front and rear ends for enabling a user to grip the center punch member with one hand and place the center punch tip adjacent a work surface;

said center punch body having a first annular spring latching groove formed therein intermediate the finger gripping section and the rear end forming a first latching shoulder;

an elongated prick punch member having a prick punch body extending between a second anvil surface at a cylindrical forward end and a prick punch tip at a prick punch head end;

said cylindrical forward end having a prescribed diameter;

said prick punch body having a second finger gripping section intermediate the forward and head ends for enabling the user to grip the prick punch member with a second hand;

said prick punch body having a second annular spring latching groove formed therein intermediate the second finger gripping section and the forward end forming a second latching shoulder;

an elongated cylindrical tension coil spring having a central section surrounding the forward end of the prick punch member and the rear end of the center punch member that extends longitudinally to spring ends that are mounted in respective latching groves, in which the tension coil spring is expandable from a retracted condition, in which the first and second anvil surfaces are held in engagement, to an expanded condition in which the user grips both of the finger gripping sections and pulls the center punch member and the prick punch member apart to separate the anvil surfaces and increase the tension of the tension coil spring;

said central section of the tension coil spring having an inside diameter that is greater than the diameters of the forward end of the prick punch member and the rear end of the center punch member to enable the forward end of the prick punch member and the rear end of the center punch member to move relative to each other without physical restriction from the central section of the tension coil spring;

each of said spring ends having a reduced inside diameter that is less than the diameters of the forward end of the prick punch member and the rear end of the center punch member that fit in respective latching grooves with the reduced diameter spring ends engaging respective latching shoulders to prevent the reduced diameter spring ends from disassociating from the respective spring latching grooves when the coil spring is in the expanded condition and to drive one of the anvil surfaces against the other anvil surface when the user releases either the center punch member or the prick punch member; and wherein the prick punch body has a longitudinal length that is greater than twice a longitudinal length of the body of the center punch member.

2. The combination center punch and prick punch impact hand tool as defined in claim 1 wherein the first and second finger gripping sections have a plurality of spaced annular gripping grooves formed therein defining annular rings therebetween to enable a user to firmly grip the rings and retract one of the members rearward a substantial distance without the user's finger slipping from the finger gripping sections and prematurely releasing the other member, and wherein the gripping grooves form sharp annular ring edges to minimize unintentional release of the gripping sections.

3. The combination center punch and prick punch impact hand tool as defined in claim 2 wherein each of the finger gripping sections have at least four spaced annular gripping grooves formed therein defining at least three gripping rings for gripping between the user's thumb and index finger.

4. The combination center punch and prick punch impact hand tool as defined in claim 2 wherein at least one of the gripping grooves in each finger gripping section has a groove depth greater than 0.040 cm.

5. The combination center punch and prick punch impact hand tool as defined in claim 2 wherein at least one of the gripping grooves in each finger gripping section has a groove depth between 0.040 cm. and 0.080 cm.

6. The combination center punch and prick punch impact hand tool as defined in claim 2 wherein at least one of the gripping grooves in each finger gripping section has a groove depth between 0.040 cm. and 0.080 cm. and a groove width of between 1.5 and 2.5 times the groove depth.

7. The combination center punch and prick punch impact hand tool as defined in claim 2 wherein each of the gripping grooves in each finger gripping section has a groove depth between 0.050 cm. and 0.080 cm. and a groove width between rings of between 1.5 and 2.5 times the groove depth.

8. The combination center punch and prick punch impact hand tool as defined in claim 2 wherein each of the gripping grooves in each finger gripping section has a groove depth between 0.040 cm. and 0.080 cm. and a groove width of between 1.5 and 2.5 times the groove depth and a ring width between grooves of between 1.5 and 2.5 times the groove depth.

9. The combination center punch and prick punch impact hand tool as defined in claim 2 wherein each of the gripping surfaces has at least three gripping rings spaced by the gripping grooves, in which each ring has a width of between 0.120 cm. and 0.200 cm.

10. The combination center punch and prick punch impact hand tool as defined in claim 2 wherein the number of gripping grooves in the first gripping section is greater than the number of the gripping grooves in the second gripping section to provide greater gripping friction in the first gripping section than in the second gripping section to minimize unintentional release of the center punch member prior to release of the prick punch member.

11. The combination center punch and prick punch impact hand tool as defined in claim 1 wherein the first gripping section has a greater gripping friction than the second gripping section to minimize unintentional release of the center punch member prior to release of the prick punch member.

12. The combination center punch and prick punch impact hand tool as defined in claim 1 wherein the first and second anvil surfaces have beveled outer perimeters to minimize engagement of the anvil surfaces with the central portion of the coil spring after extended use of the tool.

13. The combination center punch and prick punch impact hand tool as defined in claim 1 wherein the forward end of the prick punch member has a longitudinal length that is greater than four times a longitudinal length of the rear end of the center punch member.

14. The combination center punch and prick punch impact hand tool as defined in claim 1 wherein the forward end of the prick punch member has a longitudinal length that is greater than eight times a longitudinal length of the rear end of the center punch member.

15. The combination center punch and prick punch impact hand tool as defined in claim 14 wherein each of the spring latching grooves has a groove width sufficient to receive at least two coil turns of the corresponding spring end.

16. The combination center punch and prick punch impact hand tool as defined in claim 14 wherein each of the spring latching grooves has a depth greater than 0.040 cm.

17. The combination center punch and prick punch impact hand tool as defined in claim 14 wherein the coil spring has a prescribed wire diameter and wherein each of the spring latching shoulders has a depth greater than one-half of the prescribed wire diameter.

18. The combination center punch and prick punch impact hand tool as defined in claim 1 wherein each of the anvil surfaces has a beveled perimeter sufficient to enable the forward end of the prick punch member and the rear end of the center punch member to be inserted into the reduced spring ends during assembly to initially expand the inside diameter of the spring ends and move through the reduced spring ends into the central section enabling the reduced spring ends to snap into the spring latching grooves.

19. The combination center punch and prick punch impact hand tool as defined in claim 1 wherein the coil spring is pre-loaded with a initial tension greater than 1.0 lb. to hold the anvil surfaces in engagement when the coil spring is in the retracted condition.

20. The combination center punch and prick punch impact hand tool as defined in claim 1 wherein the prick punch member has a cylindrical body between the second anvil surface and the prick punch head end equal to the prescribed diameter of the forward end.

* * * * *